US011732586B2

(12) United States Patent
Rowe

(10) Patent No.: US 11,732,586 B2
(45) Date of Patent: Aug. 22, 2023

(54) METAL MATRIX COMPOSITE TURBINE ROTOR COMPONENTS

(71) Applicant: Toyota Motor Engineering & Manufacturing North America, Inc., Plano, TX (US)

(72) Inventor: Michael Paul Rowe, Pinckney, MI (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 361 days.

(21) Appl. No.: 16/874,044

(22) Filed: May 14, 2020

(65) Prior Publication Data

US 2021/0355831 A1 Nov. 18, 2021

(51) Int. Cl.

| | |
|---|---|
| ***F01D 5/14*** | (2006.01) |
| ***B22F 9/16*** | (2006.01) |
| ***B22F 5/00*** | (2006.01) |
| ***B22F 3/24*** | (2006.01) |

(Continued)

(52) U.S. Cl.

CPC ..... *F01D 5/14* (2013.01); *B22F 1/054* (2022.01); *B22F 3/24* (2013.01); *B22F 5/009* (2013.01); *B22F 9/16* (2013.01); *F01D 5/282* (2013.01); *B22F 2003/247* (2013.01); *B22F 2301/35* (2013.01); *B22F 2302/40* (2013.01); *B22F 2304/05* (2013.01); *F05D 2220/30* (2013.01); *F05D 2220/40* (2013.01);

(Continued)

(58) Field of Classification Search

CPC ... F01D 5/14; F01D 5/28; F01D 5/282; F04D 29/02; F04D 29/023; B22F 1/054

See application file for complete search history.

(56) References Cited

U.S. PATENT DOCUMENTS 5,814,408 A 9/1998 Ting et al.
8,043,066 B2 * 10/2011 Sambamurty ..... F03D 1/0675 416/241 B (Continued)

FOREIGN PATENT DOCUMENTS

CN 101314839 A 4/2010
CN 102278271 A 10/2013
EP 3495612 A1 * 6/2019 ..... F01D 5/147

OTHER PUBLICATIONS

Shirvanimoghaddam, K. et al., "Carbon fiber reinforced metal matrix composites: Fabrication processes and properties", Composites: Part A 92, pp. 70-96 (2017).

(Continued)

*Primary Examiner* — Topaz L. Elliott
*Assistant Examiner* — Cameron A Corday
(74) *Attorney, Agent, or Firm* — Christopher G. Darrow; Darrow Mustafa PC

(57) ABSTRACT

Carbon fiber reinforced metal matrix composite turbine rotors include a planar carbon fiber structure encapsulated within a metal matrix formed of sintered metal nanoparticles. The metal nanoparticles can include a metal having a high sintering temperature that would ordinarily destroy the carbon fiber. Novel techniques for making small uniform nanoparticles for sintering lowers the sintering temperature to a level that can accommodate carbon fiber. The composite rotors possess high strength to weight ratio.

11 Claims, 8 Drawing Sheets

(51) Int. Cl.
*F01D 5/28* (2006.01)
*B22F 1/054* (2022.01)

(52) U.S. Cl.
CPC ..... *F05D 2230/22* (2013.01); *F05D 2300/17* (2013.01); *F05D 2300/171* (2013.01)

(56) References Cited

U.S. PATENT DOCUMENTS

2012/0124994 A1* 5/2012 Hommes ..... F04D 29/284 60/605.1
2012/0153216 A1* 6/2012 Wrosch ..... B82Y 30/00 252/74
2016/0130689 A1* 5/2016 Choi ..... C21D 6/00 148/579
2018/0079884 A1 3/2018 Rowe

OTHER PUBLICATIONS

Adebisi, A., et al., "Metal Matrix Composite Brake Rotors: Historical Development and Product Life Cycle Analysis," International Journal of Automotive and Mechanical Engineering, 4, pp. 471-480 (2011).
Miracle, D.B., "Metal matrix composites—From science to technological significance," Composites Science and Technology, 65, pp. 2526-2540 (2005).
Ceschini, L. "Aluminum and Magnesium Metal Matrix Nanocomposites," ISBN 978-981-10-2681-2 (2017).
Embury, D. et al., "Steel-Based Composites: Driving Forces and Classifications," Annu. Rev. Mater. Res., 40, pp. 213-241 (2010).
Mortensen, A. et al., "Metal Matrix Composites," Annu. Rev. Mater. Res., 40, pp. 243-270 (2010).

* cited by examiner

METAL MATRIX COMPOSITE TURBINE ROTOR COMPONENTS

TECHNICAL FIELD

The present disclosure generally relates to composite turbine rotor components and, more particularly, to such components formed of carbon fiber reinforced metal matrix composites.

BACKGROUND

The background description provided herein is for the purpose of generally presenting the context of the disclosure. Work of the presently named inventors, to the extent it may be described in this background section, as well as aspects of the description that may not otherwise qualify as prior art at the time of filing, are neither expressly nor impliedly admitted as prior art against the present technology.

Reduction in the weight of engines has the potential to improve performance, including fuel efficiency and acceleration. Development of composite parts for engine components has thus been an area of focus, in order to decrease engine weight. It is of course important that such weight diminishing substitutions can be made while maintaining structural integrity and durability.

Turbines are integral engine components in both airplanes and automotive vehicles (i.e. cars). Turbochargers enhance power and efficiency of automobile combustion engines, and turbojets propel jet airplanes.

Turbine and compressor rotors are exposed to considerable strain in the operation of such engines. Depending on the rotor composition (e.g. S45C carbon steel vs. SCM440 chrome/molybdenum steel) and heat treatment during manufacture (e.g. thermal refining vs. induction hardening), the hardness of the bulk metal from which a rotor is formed can vary, but rarely exceeds a tensile strength of about 880 $N/mm^2$. Titanium alloys could potentially provide tensile strength as high as about 1100 $N/mm^2$ with a 40% weight reduction, but would incur substantial cost increase.

Accordingly, it would be desirable to provide rotors formed of metal matrix composites having lower density and equal or greater strength compared to the base metals themselves.

SUMMARY

This section provides a general summary of the disclosure, and is not a comprehensive disclosure of its full scope or all of its features.

In various aspects, the present teachings provide a turbocharger rotor. The rotor includes a turbine wheel, compressor wheel, and an axial shaft mechanically connected to the turbine wheel and compressor wheel. At least one of the turbine wheel, compressor wheel, and axial shaft includes a carbon fiber reinforced metal matrix composite (CF-MMC). The CF-MMC includes at least one reinforcing carbon fiber structure; and a continuous metal matrix, of sintered metal nanoparticles, disposed around the at least one reinforcing carbon fiber structure. The melting point of the metal or metal alloy of the nanoparticles in the bulk is above 1500° C.

In other aspects, the present teachings provide a turbojet rotor. The turbojet rotor includes a plurality of compressor disks, a plurality of turbine disks, and an axial shaft mechanically connecting the plurality of compressor disks to the plurality of turbine disks. At least one of the plurality of compressor disks; the plurality of turbine disks, and the axial shaft is formed of a carbon fiber reinforced metal matrix composite (CF-MMC). The CF-MMC includes a continuous metal matrix having sintered metal nanoparticles, the melting point of the metal or metal alloy of the nanoparticles in the bulk is above 1500° C. The CF-MMC further includes at least one carbon fiber structure at least partially encapsulated within the continuous metal matrix.

In still other aspects, the present teachings provide a method for forming a composite rotor portion for a turbine-driven device. The method includes a step of providing steel nanoparticles. The method further includes a step of combining the steel nanoparticles with a reinforcing carbon fiber component, in a die or cast corresponding to a desired rotor portion shape, to produce an unannealed combination having the desired rotor portion shape. The method further includes sintering the steel nanoparticles to produce the composite rotor portion.

Further areas of applicability and various methods of enhancing the above coupling technology will become apparent from the description provided herein. The description and specific examples in this summary are intended for purposes of illustration only and are not intended to limit the scope of the present disclosure.

BRIEF DESCRIPTION OF THE DRAWINGS

The present teachings will become more fully understood from the detailed description and the accompanying drawings, wherein.

It should be noted that the figures set forth herein are intended to exemplify the general characteristics of the methods, algorithms, and devices among those of the present technology, for the purpose of the description of certain aspects. These figures may not precisely reflect the characteristics of any given aspect, and are not necessarily intended to define or limit specific embodiments within the scope of this technology. Further, certain aspects may incorporate features from a combination of figures.

DETAILED DESCRIPTION

The present disclosure generally relates to rotors for turbine driven devices and components or portions of said rotors. Disclosed rotors and components thereof include metal matrix composites reinforced with carbon fiber. The rotors, including both turbine and compressor rotors, can have improved strength-to-weight ratios in comparison to conventional rotors, which are conventionally formed of unreinforced metals.

The turbine rotors and turbine components according to the present technology can be used in any type of turbine engine, including generators and other machinery. In various aspects pertaining to automotive and aircraft technology, disclosed rotors may have at least one turbine and at least one compressor, connected by a shaft. At least one of these components is formed of a composite material having a continuous metal matrix, itself formed of sintered metal nanoparticles. One or more carbon fiber structures, such as carbon fiber weave, may be partially or completely embedded within the metal matrix. The continuous metal matrix is typically formed of a high temperature metal, particularly steel. Rotor components of the present teachings are formed through a specialized sintering/powder metallurgy approach. Conventionally available steel powder at temperatures of about 1100 to 1300° C. Such a high temperature would destroy the carbon fiber in the presence of air or oxygen, and the density difference between carbon fiber and steel would prevent penetration of the metal matrix into the carbon fiber due to buoyancy. Accordingly, the present technology for forming a steel/polymer composite employs steel nanoparticles, lowering the melting point of steel to less than about 450° C. When combined and heated, this allows for the steel nanoparticles to sinter around the reinforcing carbon fiber component, without destroying the reinforcing carbon fiber component.

Figure 1A:
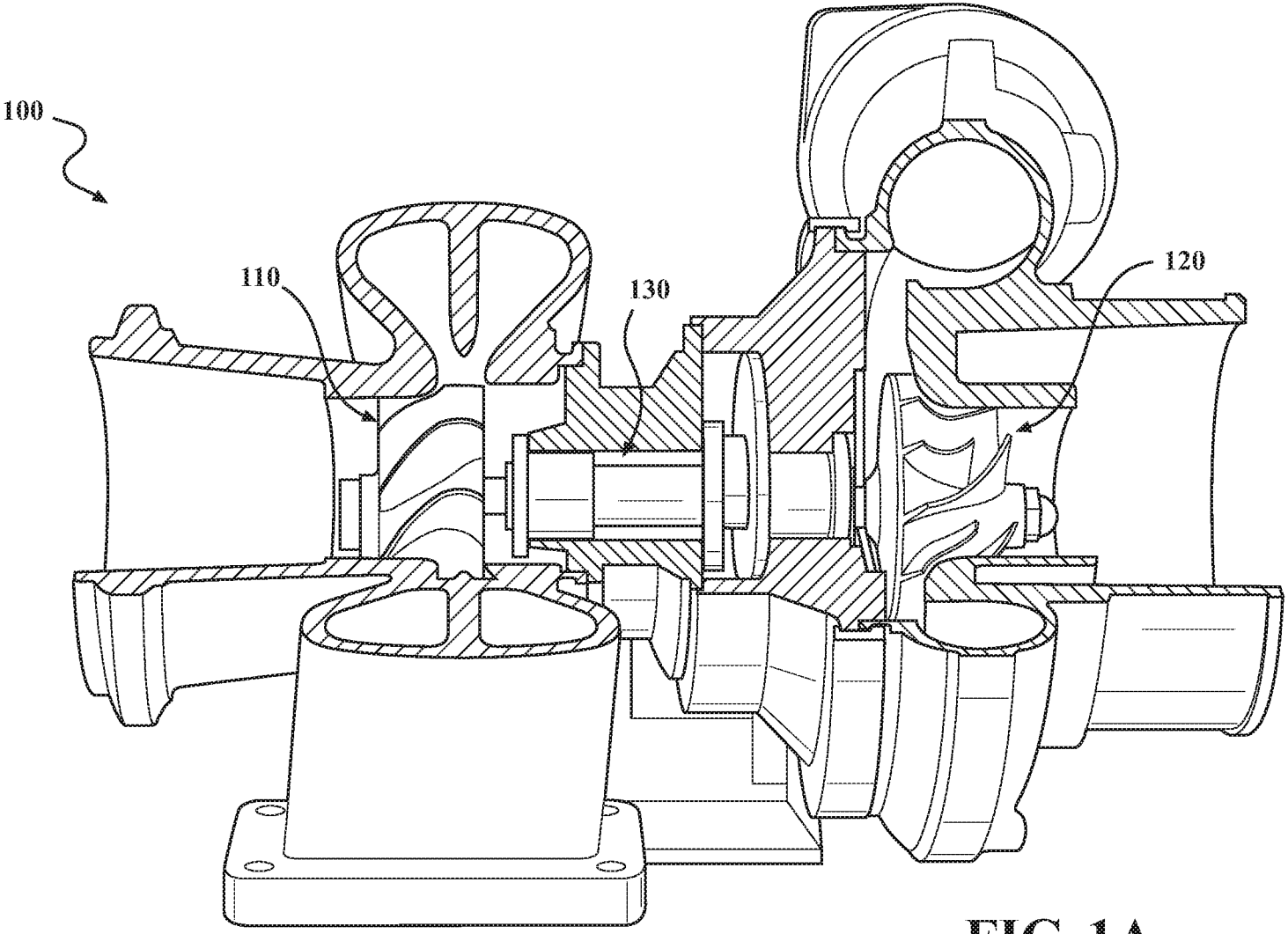
FIG. 1A is a cutaway perspective view of a turbocharger for an automotive vehicle.

FIG. 1A shows a cutaway perspective view of a turbocharger 100 for an automotive vehicle. The turbocharger 100 has a rotor that includes a turbine wheel 110, a compressor wheel 120, and an axial shaft 130 mechanically connected to the turbine wheel 110 and compressor wheel 120. It will be understood that vehicle exhaust flow drives the turbine wheel 110, which in turn drives the compressor wheel 120, via the axial shaft 130. The compressor wheel 120 then provides compressed air to the combustion engine for increased power and efficiency.

Figure 1B:
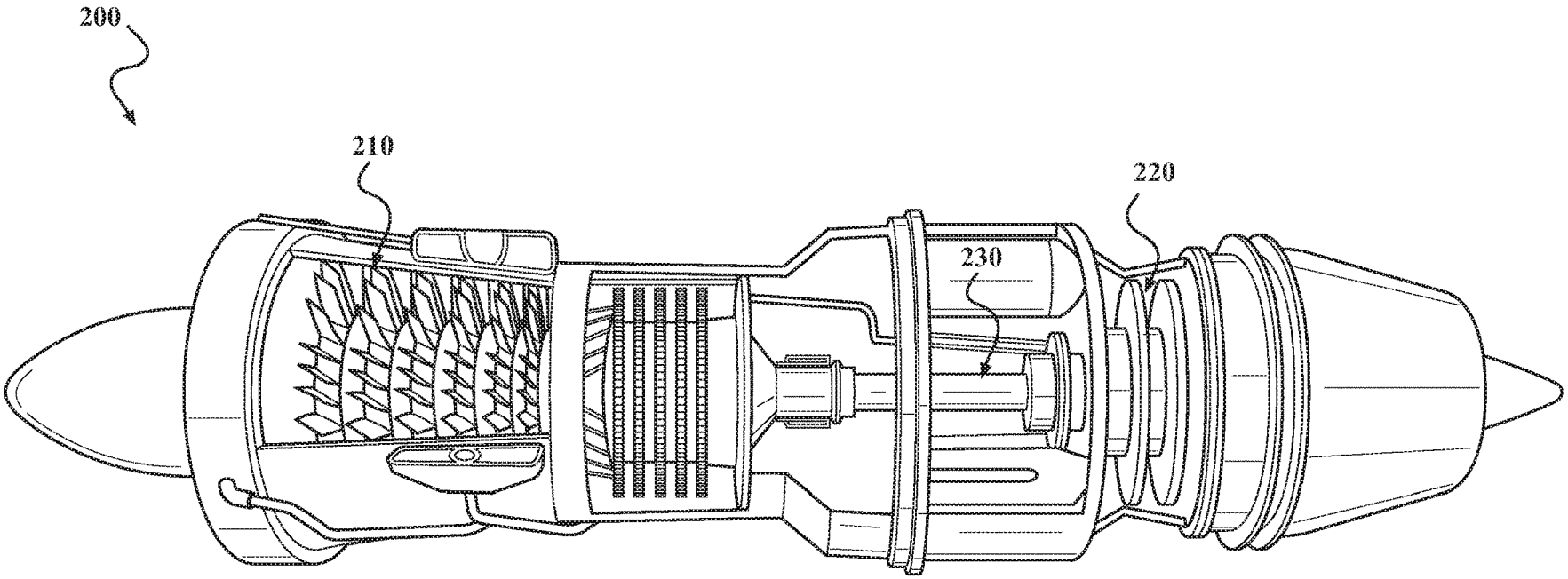
FIG. 1B shows a cutaway perspective view of a turbojet for a jet airplane.

FIG. 1B shows a cutaway perspective view of a turbojet 200 for a jet airplane. The turbojet similarly has a rotor that includes a plurality of turbine disks 210, a plurality of compressor disks 220, and an axial shaft 230 that mechanically connects the plurality of turbine disks 210 and the plurality of compressor disks. The axial shaft 230 passes through a combustion portion, where fuel is ignited, producing exhaust gas. It will be understood that rotation of the plurality of turbine disks 210, impelled by exhaust gas from the combustion portion 215, further causes rotation of the plurality of compressor disks 220. It will further be understood that rotation of the compressor disks 220 causes compressed air to be fed to the combustion portion 215, thereby increasing power and efficiency.

Because the operation of the turbocharger 100 of FIG. 1A and the turbojet of FIG. 1B involve high radial velocity revolution of the turbine wheels/disks 110, 210 and compressor wheels/disks 120, 220 are subject to substantial mechanical stress. In addition, operation of the turbocharger and/or turbojet can be enhanced by decreasing weight of the wheels/disks 110, 120, 210, 220 without concomitant strength loss. It is to be understood that, within the context of a turbocharger 100 or a turbojet 200, as described above, a "rotor" refers to a connected rotating structure. Thus, in the case of the turbocharger 100, the rotor includes the turbine wheel 110, the compressor wheel 120, and the axial shaft 130. Similarly, in the case of the turbojet 200, the rotor includes turbine disks 210, compressor disks 220, and axial shaft 230. As such, turbine wheels and disks 110, 210; compressor wheels and disks 120, 220; and axial shafts 130, 230 can be referred to collectively herein as "rotor portions," and a "rotor portion" 110, 210, 120, 220, 130, or 230 can refer to any of the named components.

Figure 2A:
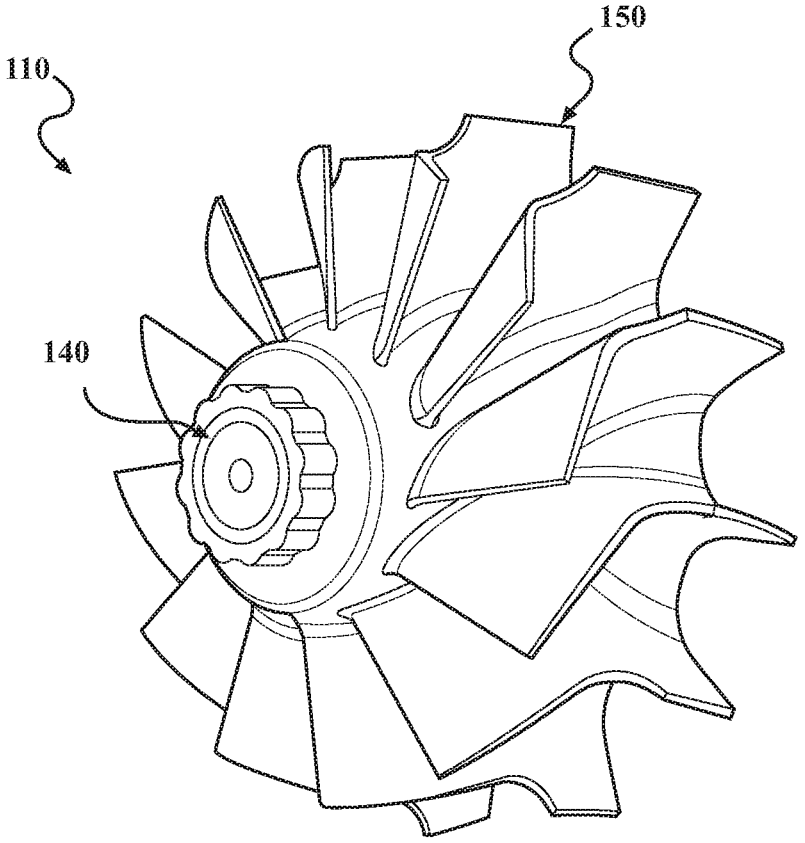
FIG. 2A is a perspective view of a turbine wheel of a turbocharger of FIG. 1A.
Figure 2B:
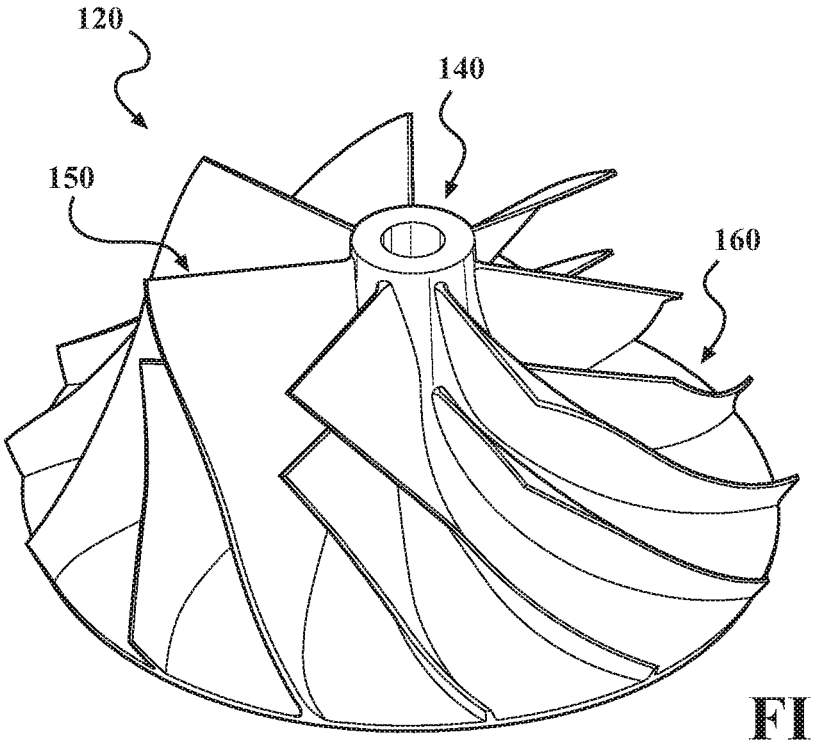
FIG. 2B is a perspective view of a compressor wheel of a turbocharger of FIG. 1A.

FIG. 2A shows a perspective view of a representative turbine wheel 110 of a turbocharger 100 and FIG. 2B shows a representative compressor wheel 120 of a turbocharger 100. Each of the turbocharger 100 wheels 110, 120 has a central hub 140 with a plurality of blades 150 extending radially outward therefrom. The plurality of blades 150 are configured to drive turbine rotation in the case of the turbine wheel 110 of FIG. 2A, or to impel air flow when rotated, in the case of the compressor wheel 120 of FIG. 2B. With reference to FIG. 2B, a compressor wheel 120 can include a planar backing portion 160, which provides additional structural support to the plurality of blades 150.

Figure 3A:
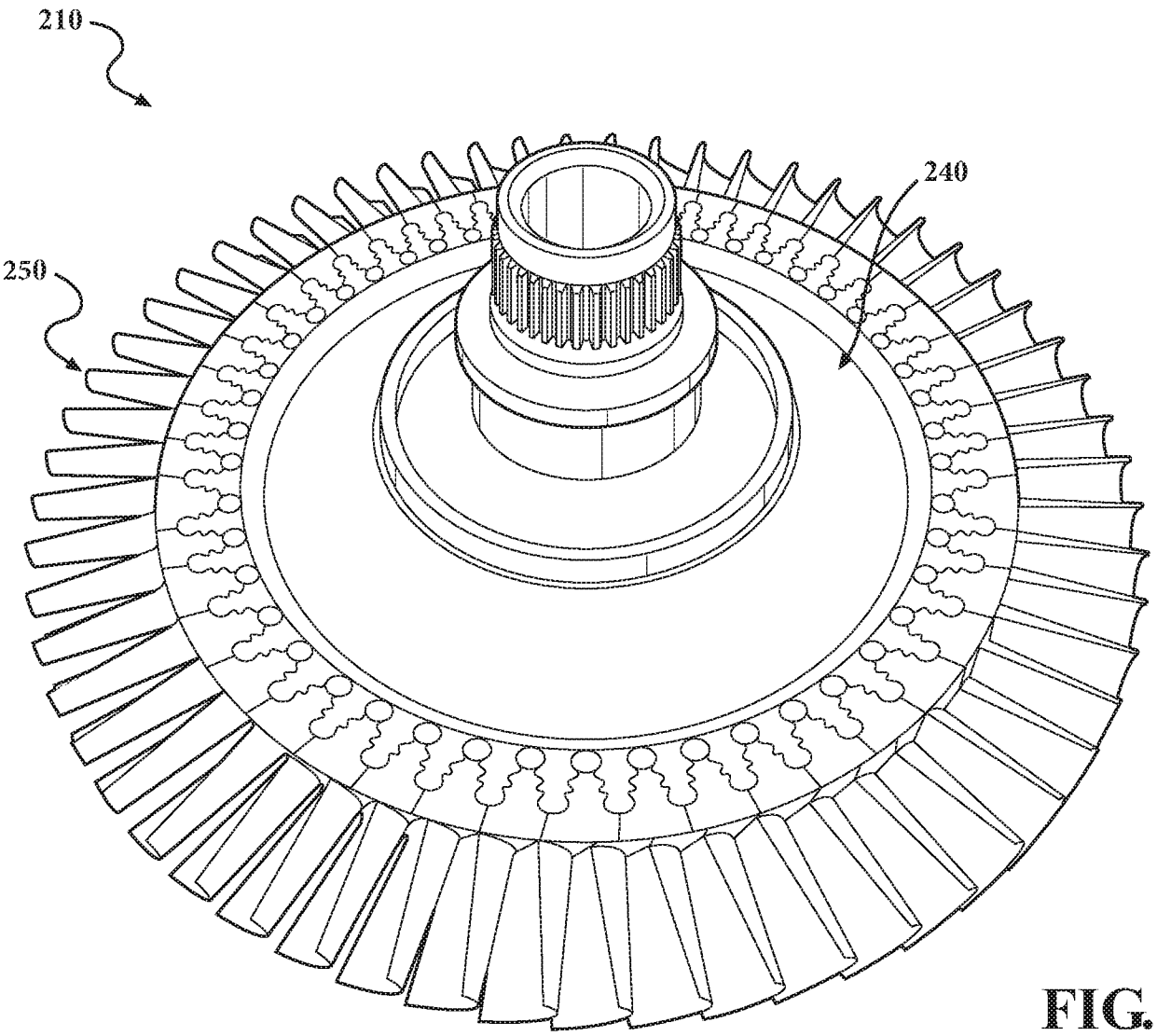
FIG. 3A is a perspective view of a turbine disk of a turbojet of FIG. 1B.
Figure 3B:
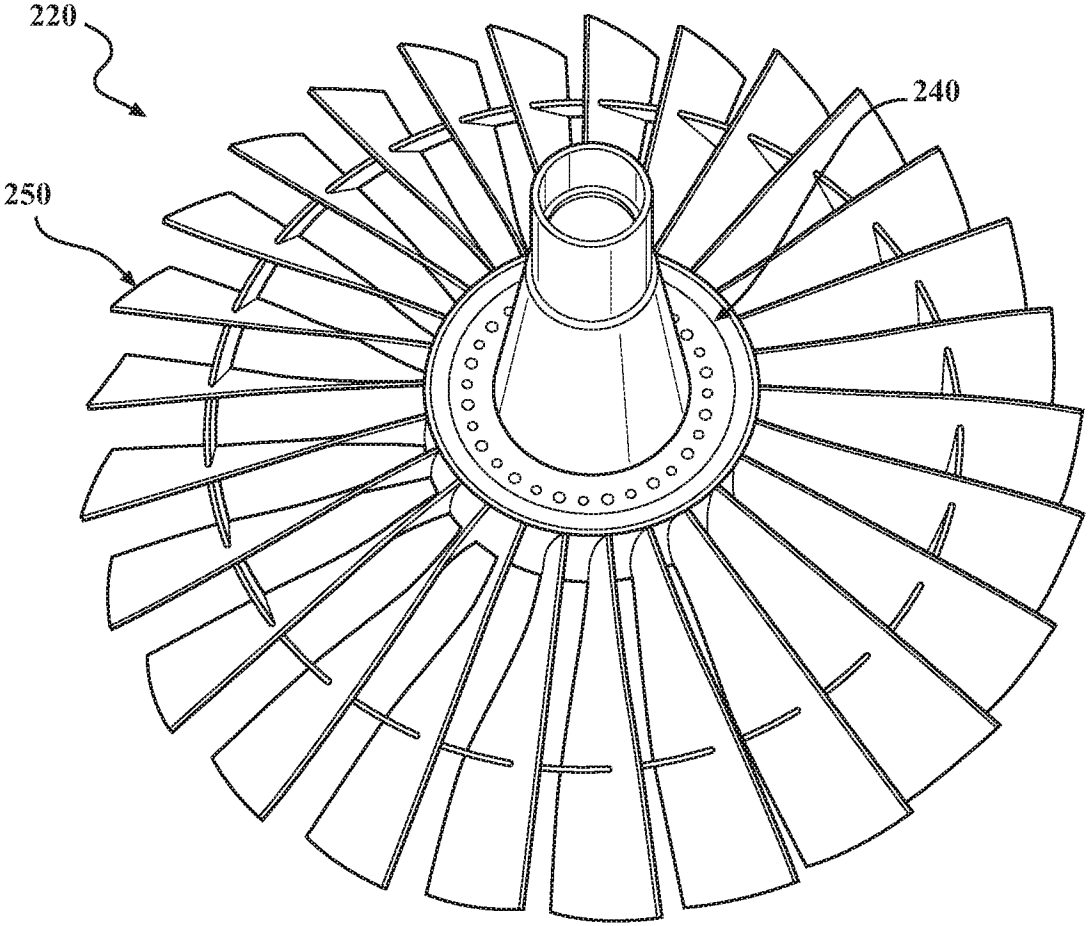
FIG. 3B is a perspective view of a compressor disk of a turbojet of FIG. 1B.

FIG. 3A shows a perspective view of a representative turbine disk 210 of a turbojet 200, and FIG. 3B shows a perspective view of a representative compressor disk 220 of a turbojet 200. The turbine disk 210 and the compressor disk 220 each include a hub 240 and a plurality of blades 250 radially arrayed from hub 240.

Figure 4A:
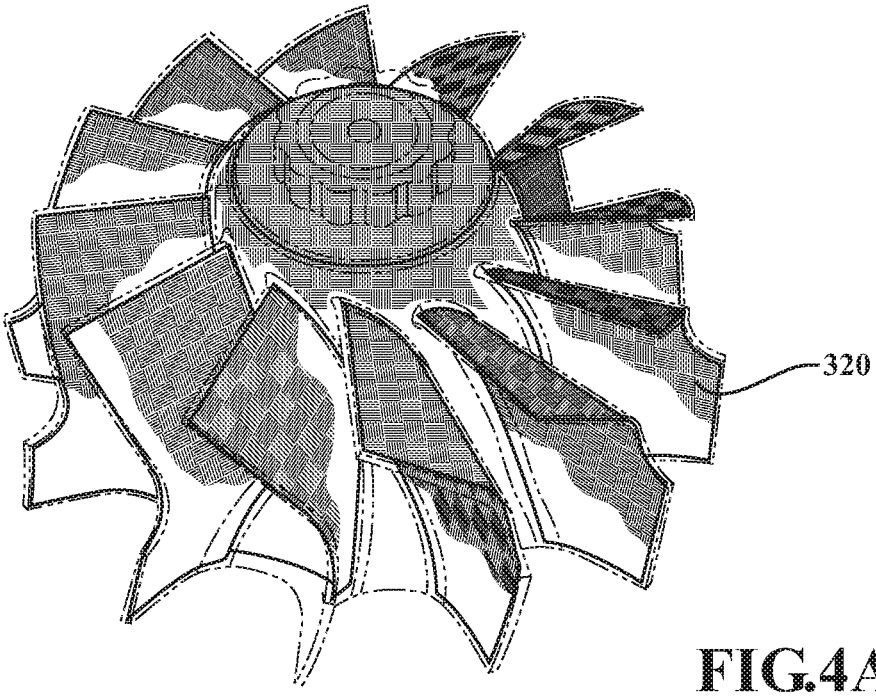
FIG. 4A is a perspective view of the turbine wheel of FIG. 2A illustrating an interior region.
Figure 4B:
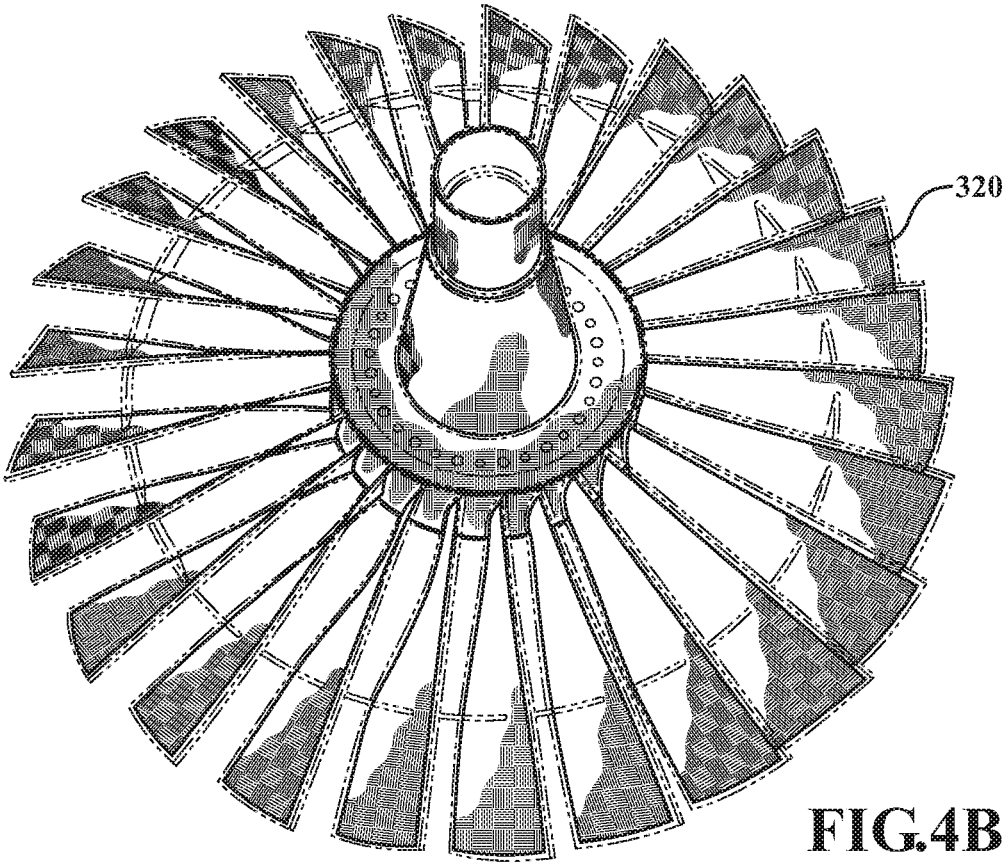
FIG. 4B is a perspective view of the compressor disk of FIG. 3B illustrating an interior region.
Figure 4C:
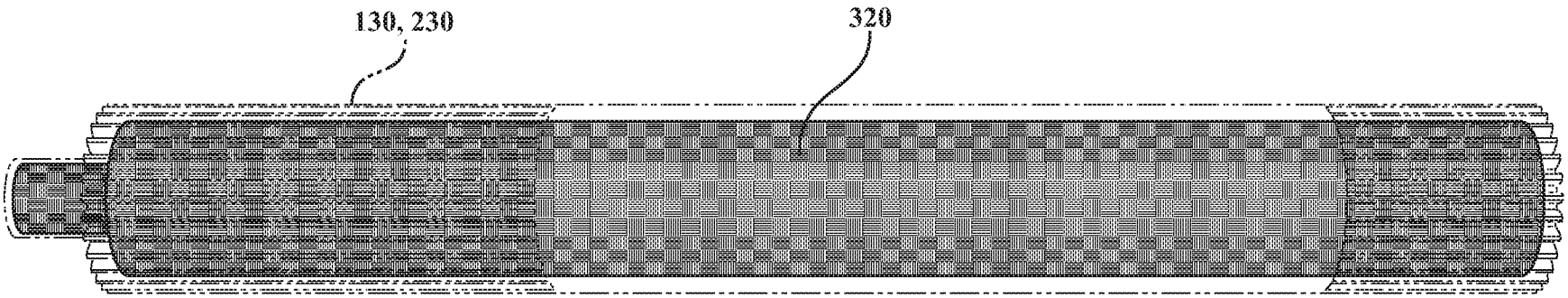
FIG. 4C is a perspective view of an axial shaft such as that present in the turbocharger of FIG. 1A, illustrating an interior region.

FIG. 4A is a perspective view of the turbine wheel 110 of FIG. 2A, illustrating the internal structure/composition of the wheel 110. FIG. 4B shows a comparable perspective view of the compressor disk 220 of FIG. 3B. FIG. 4C is a perspective view of an axial shaft 130 of a turbocharger, illustrating the internal structure/composition of the shaft 130. Referring to the wheel 110 of FIG. 4A and the disk 220 of FIG. 4B, a turbine or compressor wheel or disk 110, 120, 210, 220 of the present teachings can be formed of a carbon fiber metal matrix composite (CF-MMC) having a metal matrix 300 reinforced with at least one carbon fiber structure 320. The at least one carbon fiber structure 320 (alternatively referred to, for simplicity, merely as "the carbon fiber structure 320") can be a flexible, planar, two-dimensional structure of multiple carbon fibers, such as a carbon fiber mesh, weave, or fabric. Similarly, and with reference of FIG. 4C, an axial shaft 130, 230 of the present teachings can be formed of a carbon fiber/metal matrix composite (CF-MMC) having a metal matrix 300 reinforced with at least one carbon fiber structure 320, as described. In various implementations, a carbon fiber structure 320 can be present in the hub 140, 240 or in each of the blades 150, 250 of the wheel/disk 110, 120, 210, 220, or throughout the entirety of the wheel/disk 110, 120, 210, 220. In some variations in which a carbon fiber structure 320 is present in each of the blades 150, 250, a continuous carbon fiber structure 320 can extend into each of the blades 150, 250. In other variations, separate carbon fiber structures 320 can extend into each blade 150, 250.

The continuous metal matrix 300 can be generally formed of sintered nanoparticles of a constituent metal having a melting temperature greater than about 1500° C. Exemplary metals include, without limitation, steel, titanium, iron, nickel, and various alloys thereof. In some implementations, the continuous metal matrix can be formed of sintered nanoparticles of a nickel alloy having at least 40%, or at least 60%, or at least 90% nickel. It will be understood that such metals, having a typical sintering temperature that would destroy carbon fiber and that special measures, including formation of small size and regular distribution nanoparticles, must be taken to lower the sintering temperature to a level that will accommodate carbon fiber. In variations where the metal matrix 300 is formed of steel, it can optionally include any, several, or all, of: manganese, nickel, chromium, molybdenum, boron, titanium, vanadium, tungsten, cobalt, niobium, phosphorus, sulfur, and silicon. Relative ratios of the various elemental components of the steel matrix 300 can depend on the desired application, and will generally be selectable based on common knowledge to one of skill in the art. For example, an application requiring stainless steel can include chromium present at greater than or equal to 11%, by weight, of the total weight. In one disclosed Example, the steel matrix consists of iron, carbon, and manganese present at 99.08%, 0.17%, and 0.75%, respectively, by weight of the steel matrix. It will be understood that the term "weight" as used here is interchangeable with the term "mass".

In some implementations, the term "continuous", as used in the phrase, "continuous metal matrix 300" can mean that the metal matrix is formed as, or is present as, a unitary, integral body. In such implementations, and as a negative example, a structure formed of two distinct metal bodies held together such as with an adhesive or with a weld would be discontinuous. In some implementations, the term "continuous" as used herein can mean that a continuous steel matrix 300 is substantially compositionally and structurally homogeneous throughout its occupied volume. For simplicity, the continuous metal matrix 300 will be alternatively referred to herein as "metal matrix 300", i.e. the word "continuous" will at times be omitted without changing the meaning.

The description that the at least one carbon fiber structure 320 is "encapsulated within the continuous metal matrix 300" can mean that at least a portion of individual fibers comprising the at least one reinforcing carbon fiber structure 320 are contactingly surrounded by the continuous metal matrix 300. In some implementations, the expression, "fully encapsulated within the continuous metal matrix 300" can mean that the continuous metal matrix 300 is partially or fully formed around or otherwise contactingly disposed around the at least one reinforcing carbon fiber structure 320.

While FIGS. 4A and 4B illustrate rotor portions having single layers of reinforcing carbon fiber structure 320 encapsulated within the metal matrix 300, it is to be understood that the composite material can include any number of layers of reinforcing carbon fiber structure 320 greater than or equal to one. Stated alternatively, the at least one reinforcing carbon fiber structure 320 can, in some implementations, include a plurality of mutually contacting or spatially separated layers of reinforcing carbon fiber. It is further to be understood that the weight ratio of carbon fiber structure 320 to metal matrix 300 within the rotor portion 110, 210, 120, 220, 130, 230 can be substantially varied, and that such variation will have a direct influence on the density of the rotor portion given the considerably different densities of carbon fiber (typically less than 2 g/cm$^3$), and, as an example, steel (typically more than 7 g/cm$^3$).

Thus, in some implementations, a rotor portion 110, 210, 120, 220, 130, or 230 of the present disclosure will have density less than 7 g/cm$^3$. In some implementations, a rotor portion 110, 210, 120, 220, 130, or 230 of the present disclosure will have density less than 6 g/cm$^3$. In some implementations, a rotor portion 110, 210, 120, 220, 130, or 230 of the present disclosure will have density less than 5 g/cm$^3$.

Because the carbon fiber structure 320 is, on its own, generally a flexible structure, it can be bent or curved as needed to accommodate the shape of the structure in which it is resident. Thus, and with reference to FIGS. 4A and 4B, it will be noted that the blades 150, 250 of a compressor or turbine wheel or disk 110, 120, 210, 220 are often curved or otherwise not coplanar. The carbon fiber structure 320 can be curved, twisted, etc. to accommodate such structures. Similarly, and with reference to FIG. 4C, when a carbon fiber structure 320 is resident in an axial shaft 130, 230, the carbon fiber structure 320 can be formed is a roll or tube to properly fit within the shaft 130, 230.

It will be understood that the disclosed composition technology can be applied to other turbine systems, outside the confines of a turbocharger or turbojet, and outside the confines of a coupled turbine/compressor. Such applicable turbine systems can include a steam turbine, such as used in an electricity generation plant; a wind turbine; or a supercharger for an automotive vehicle, in which the compressor is driven by mechanical connection to the engine's crankshaft.

Figure 5:
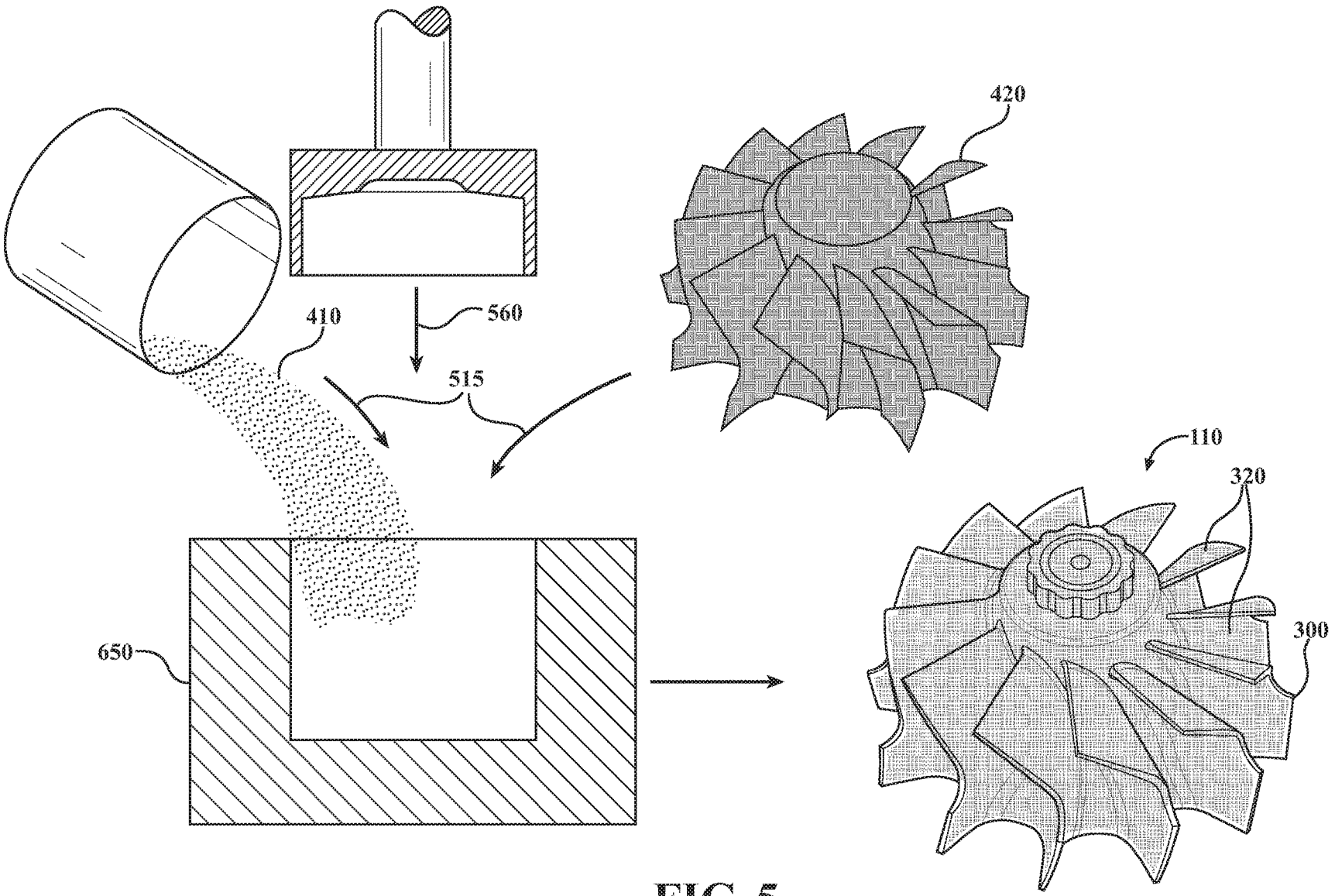
FIG. 5 is a block diagram of a method for making a composite portion of the present teachings.

Also disclosed is a method for forming a turbine rotor portion, such as in a turbocharger 100 or turbojet 200, the rotor portion including CF-MMC. FIG. 5 shows a schematic representation of one exemplary method. With reference to FIG. 5, the method includes a step of providing metal nanoparticles 410. The term "metal nanoparticles 410" refers generally to a sample consisting predominantly of particles of steel having an average maximum dimension less than 100 nm. Individual particles of the metal nanoparticles 310 will generally consist of any alloy as compositionally described above with respect to the metal matrix 300 of the CF-MMC.

With continued reference to FIG. 5, the method for forming a rotor portion additionally includes a step of combining 515 the metal nanoparticles 410 with a reinforcing carbon fiber component 420 to produce an unannealed combination. The reinforcing carbon fiber component 420 is in all respects identical to the reinforcing carbon fiber structure 320 as described above with respect to the rotor portions, with the exception that the reinforcing carbon fiber component 420 is not yet integrated into, or encapsulated within, a continuous metal matrix 300 as defined above. Thus, the reinforcing carbon fiber component 420 can include, for example, carbon fibers formed in any configuration designed to impart tensile strength in at least one dimension, in some aspects in at least two-dimensions.

In many implementations, the combining step 515 will include sequentially combining at least one layer of metal nanoparticles 410 and at least one layer of reinforcing carbon fiber component 420, such that the unannealed combination consists of one or more layers each of metal nanoparticles 410 and reinforcing carbon fiber component 420. Any number of layers of metal nanoparticles 410 and any number of layers of reinforcing carbon fiber component 420 can be employed.

The combining step 515 will generally include combining the metal nanoparticles 410 and the reinforcing carbon fiber component 420 within a die, cast, or mold corresponding to the shape of the rotor portion (such as a turbine or compressor wheel or disk 110, 120, 210, 220) to be formed. In some particular implementations, the at least one layer of metal nanoparticles 410 and the at least one layer of reinforcing carbon fiber component 420 will be combined within a heat press die 650.

In some implementations, the method for forming a rotor portion can include a step of manipulating metal nanoparticles 410 in the unannealed combination into interstices in the reinforcing carbon fiber component 420. Such a manipulating step can be effective to maximize surface area of contact between metal nanoparticles 310 and the reinforcing carbon fiber component 420 in the unannealed combination, improving the effectiveness of integration of the reinforcing carbon fiber structure 320 into the continuous matrix 300 of the eventually formed rotor portion. Manipulating metal nanoparticles 410 into interstices in the reinforcing carbon fiber component 420 can be accomplished by any procedure effective to increase surface area of contact between metal nanoparticles 410 and reinforcing carbon fiber component 420, including without limitation: pressing, agitating, shaking, vibrating, sonicating, or any other suitable procedure.

The method for forming a rotor portion additionally includes a step of sintering the metal nanoparticles 410, thereby converting the metal nanoparticles 410 into a continuous metal matrix 300 such that the reinforcing carbon fiber component 420 becomes a reinforcing carbon fiber structure 320 integrated into the continuous metal matrix 300; and thus converting the unannealed combination into a fully formed composite rotor portion. The sintering step generally includes heating the unannealed combination to a temperature within the thermal stability range of carbon fiber and sufficiently high to sinter the metal nanoparticles 310. In some implementations, the sintering step can include heating the unannealed combination to a temperature greater than 400° C. and less than about 1500° C. In some implementations, the sintering step can include heating the unannealed combination to a temperature greater than 420° C. and less than about 1000° C.

In some implementations, the sintering step can be achieved by hot compaction, i.e. by applying elevated pressure 510 simultaneous to the application of elevated temperature. In some implementations employing hot compaction, the elevated pressure can be at least 30 MPa; and in some implementations, the elevated pressure can be at least 60 MPa. Depending on the sintering conditions of temperature and pressure, the duration of the sintering step can vary. In some implementations, the sintering step can be performed for a duration within a range of 2-10 hours, and in one disclosed Example is performed for a duration of 4 hours. In some implementations, the method can include steps of machining and polishing the part to obtain the fully fabricated rotor portion.

It will be appreciated that in some instances, providing metal nanoparticles 310 having a desired composition, average maximum dimension, and/or relative standard deviation of the average maximum dimension may be difficult to achieve by conventional methods. For example, "top down" approaches involving fragmentation of bulk metal into particulate metal via milling, arc detonation, or other known procedures will often provide metal particles that are too large and/or too heterogeneous for effective sintering into a uniform, robust continuous metal matrix 300. This is particularly true for metal that are particularly hard and/or dense, such as steel or titanium. "Bottom up" approaches, such as those involving chemical reduction of dissolved cations, will often be unsuitable for various alloy nanoparticles due to incompatible solubilities, or even unavailability, of the relevant cations. For example, cationic carbon, that is suitable for chemical co-reduction with cationic iron to form steel, may be difficult to obtain. Further, even where these techniques or others may be effective to produce metal nanoparticles 310 of a given composition at laboratory scale, scale up may prove unfeasible or uneconomical.

For these reasons, the step of providing metal nanoparticles 310 can in many implementations be performed by a novel metal nanoparticle 310 synthesis using Anionic Element Reagent Complexes (AERCs). An AERC generally is a reagent consisting of one or more elements in complex with a hydride molecule, and having a formula:

$$Q^0.X_y \qquad \text{Formula I,}$$

wherein $Q^0$ represents a combination of one or more elements, each formally in oxidation state zero and not necessarily in equimolar ratio relative to one another; X represents a hydride molecule, and y is an integral or fractional value greater than zero. An AERC of Formula I can be formed by ball-milling a mixture that includes: (i) powders of each of the one or more elements of the desired metal(s), present at the desired molar ratios; and (ii) a powder of the hydride molecule, present at a molar ratio relative to the combined one or more elements that corresponds to y. In many implementations, the hydride molecule will be a borohydride, and in some specific implementations the hydride molecule will be lithium borohydride.

Contacting an AERC of Formula I with a suitable solvent and/or ligand molecule will result in formation of nanoparticles consisting essentially of the one or more elements, the one or more elements being present in the nanoparticles at ratios equivalent to which they are present in the AERC.

Thus, an AERC suitable for use in metal nanoparticle 410 synthesis, where the metal is steel as an example, generally has a formula:

$$Fe_aC_bM_d.X_y \qquad \text{Formula II,}$$

where Fe is elemental iron, formally in oxidation state zero; C is elemental carbon, formally in oxidation state zero; M represents one or more elements in oxidation state zero, each of the one or more elements selected from a group including Mn, Ni, Cr, Mo, B, Ti, V, W, Co, Nb, P, S, and Si; X is a hydride molecule as defined with respect to Formula I; a is a fractional or integral value greater than zero; b is a fractional or integral value greater than zero; d is a fractional or integral value greater than or equal to zero; and y is a fractional or integral value greater than or equal to zero. It will be appreciated that the values of a, b, and c will generally correspond to the molar ratios of the various components in the desired composition of steel. It is further to be understand that M and d are shown as singular values for simplicity only, and can correspond to multiple elements present at non-equimolar quantities relative to one another. An AERC of Formula II can alternatively be referred to as a steel-AERC.

Formation of a steel-AERC can be accomplished by ball-milling a mixture that includes: (I) a powder of a hydride molecule, such as lithium borohydride; and (II) a pre-steel mixture that includes (i) iron powder; (ii) carbon powder; and (iii) optionally, powder(s) of one or more elements selected from a group including Mn, Ni, Cr, Mo, B, Ti, V, W, Co, Nb, P, S, and Si. This mixture is to include iron powder, carbon powder, and optional powder(s) of one or more selected elements, at weight ratios identical to the weight ratios of these various components in a desired steel product. For example, in order to synthesis a stainless steel type 316 product having, by weight, 12% Ni, 17% Cr, 2.5% Mo, 1% Si, 2% Mn, 0.08% C, 0.045% P, and 0.03 S, the pre-steel mixture, to be combined with powder of a hydride molecule for ball milling, should include powders of each of these elements present in the listed percentages by weight.

Thus, in some implementations, a disclosed process for synthesizing steel nanoparticles includes a step of contacting a steel-AERC, such as one defined by Formulae I or II, with a solvent. In some implementations, the disclosed process for synthesizing steel nanoparticles includes a step of contacting a steel-AERC, such as one defined by Formulae I or II, with a ligand. In some implementations, the disclosed process for synthesizing steel nanoparticles includes a step of contacting a steel-AERC, such as one defined by Formulae I or II, with a solvent and a ligand. Contacting a steel-AERC with a suitable solvent and/or ligand will result in formation of metal nanoparticles 310 having alloy composition dictated by the composition of the steel-AERC, and thus by the composition of the pre-steel mixture from which the steel-AERC was formed.

Non-limiting examples of suitable ligands can include nonionic, cationic, anionic, amphoteric, zwitterionic, and polymeric ligands and combinations thereof. Such ligands typically have a lipophilic moiety that is hydrocarbon based, organosilane based, or fluorocarbon based. Without implying limitation, examples of types of ligands which can be suitable include alkyl sulfates and sulfonates, petroleum and lignin sulfonates, phosphate esters, sulfosuccinate esters, carboxylates, alcohols, ethoxylated alcohols and alkylphenols, fatty acid esters, ethoxylated acids, alkanolamides, ethoxylated amines, amine oxides, nitriles, alkyl amines, quaternary ammonium salts, carboxybetaines, sulfobetaines, or polymeric ligands. In some particular implementations, a ligand can be at least one of a nitrile, an amine, and a carboxylate.

Non-limiting examples of suitable solvents can include any molecular species, or combination of molecular species, capable of interacting with the constituents of an AERC by means of non-bonding or transient-bonding interactions. In different implementations, a suitable solvent for synthesis of metal nanoparticles 410 from a steel-AERC can be a hydrocarbon or aromatic species, including but not limited to: a straight-chain, branched, or cyclic alkyl or alkoxy; or a monocyclic or multicyclic aryl or heteroaryl. In some implementations, the solvent will be a non-coordinating or sterically hindered ether. The term solvent as described can in some variations include a deuterated or tritiated form. In some implementation, a solvent can be an ether, such as THF.

The present invention is further illustrated with respect to the following examples. It needs to be understood that these examples are provided to illustrate specific embodiments of the present invention and should not be construed as limiting the scope of the present invention.

EXAMPLE 1

Steel Nanoparticle Synthesis

To a ball mill jar is added 0.0136 g carbon, 0.06 g manganese, 7.9264 g iron, and 6.28 g lithium borohydride. This is ball-milled under an inert atmosphere for 4 hours. The steel-AERC product is washed with THF, resulting in formation of steel nanoparticles having a composition 99.08% Fe, 0.17% C, and 0.75% Mn. The formed steel nanoparticles are isolated.

EXAMPLE 2

Formation of Composite Steel

A carbon fiber weave, cut to the shape of compressor wheel, is placed in a die properly shaped to form the compressor wheel. Blade portions of the carbon fiber weave are properly placed into blade portions of the die. The steel nanoparticles of Example I are loaded into the die and encouraged into the gaps between fibers of the weave of carbon fibers during this loading step. The material is then sintered at 900° C. and 60 MPa for 4 hours. The product is a composite steel having reinforcing carbon fiber integrated into a steel matrix as illustrated in FIG. 4A. The product is machined and polished to produce the desired compressor wheel.

The preceding description is merely illustrative in nature and is in no way intended to limit the disclosure, its application, or uses. As used herein, the phrase at least one of A, B, and C should be construed to mean a logical (A or B or C), using a non-exclusive logical "or." It should be understood that the various steps within a method may be executed in different order without altering the principles of the present disclosure. Disclosure of ranges includes disclosure of all ranges and subdivided ranges within the entire range.

The headings (such as "Background" and "Summary") and sub-headings used herein are intended only for general organization of topics within the present disclosure, and are not intended to limit the disclosure of the technology or any aspect thereof. The recitation of multiple embodiments having stated features is not intended to exclude other embodiments having additional features, or other embodiments incorporating different combinations of the stated features.

As used herein, the terms "comprise" and "include" and their variants are intended to be non-limiting, such that recitation of items in succession or a list is not to the exclusion of other like items that may also be useful in the devices and methods of this technology. Similarly, the terms "can" and "may" and their variants are intended to be non-limiting, such that recitation that an embodiment can or may comprise certain elements or features does not exclude other embodiments of the present technology that do not contain those elements or features.

The broad teachings of the present disclosure can be implemented in a variety of forms. Therefore, while this disclosure includes particular examples, the true scope of the disclosure should not be so limited since other modifications will become apparent to the skilled practitioner upon a study of the specification and the following claims. Reference herein to one aspect, or various aspects means that a particular feature, structure, or characteristic described in connection with an embodiment or particular system is included in at least one embodiment or aspect. The appearances of the phrase "in one aspect" (or variations thereof) are not necessarily referring to the same aspect or embodiment. It should be also understood that the various method steps discussed herein do not have to be carried out in the same order as depicted, and not each method step is required in each aspect or embodiment.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations should not be regarded as a departure from the disclosure, and all such modifications are intended to be included within the scope of the disclosure.

What is claimed is:

1. A turbocharger rotor comprising:

a turbine wheel;

compressor wheel; and an axial shaft mechanically connected to the turbine wheel and compressor wheel;

wherein at least one of the turbine wheel, compressor wheel, and axial shaft comprises a carbon fiber reinforced metal matrix composite (CF-MMC) comprising:

at least one reinforcing carbon fiber structure; and a continuous metal matrix, of sintered metal nanoparticles, disposed around the at least one reinforcing carbon fiber structure, the metal of the nanoparticles in bulk form having a melting temperature greater than about 1500° C.

2. The turbocharger rotor as recited in claim 1, wherein the compressor wheel is formed of the CF-MMC.

3. The turbocharger rotor as recited in claim 2, wherein the compressor wheel comprises a hub and a plurality of blades extending from the hub, and wherein the at least one carbon fiber structure includes a continuous carbon fiber structure extending into each blade of the plurality of blades.

4. The turbocharger rotor as recited in claim 2, wherein the compressor wheel comprises a hub and a plurality of blades extending from the hub, and wherein the at least one carbon fiber structure includes a plurality of carbon fiber structures, each of the plurality of carbon fiber structures extending into a separate blade of the plurality of blades.

5. The turbocharger rotor as recited in claim 1, wherein the metal nanoparticles comprise steel nanoparticles.

6. The turbocharger rotor as recited in claim 5, wherein the steel nanoparticles comprise an alloy of iron, carbon, and at least one element selected from a group including: Mn, Ni, Cr, Mo, B, Ti, V, W, Co, Nb, P, S, and Si.

7. A turbojet rotor comprising:

a plurality of compressor disks;

a plurality of turbine disks; and an axial shaft mechanically connecting the plurality of compressor disks to the plurality of turbine disks;

wherein at least one of the plurality of compressor disks; the plurality of turbine disks, and the axial shaft is formed of a carbon fiber reinforced metal matrix composite comprising:

a continuous metal matrix comprising sintered metal nanoparticles, the metal of the nanoparticles in bulk form having a melting temperature greater than about 1500° C.; and at least one carbon fiber structure at least partially encapsulated within the continuous metal matrix.

8. The turbojet rotor as recited in claim 7, wherein the at least one carbon fiber structure is fully encapsulated within the continuous metal matrix.

9. The turbojet rotor as recited in claim 7, wherein the metal nanoparticles comprise nanoparticles of a nickel alloy.

10. The turbojet rotor as recited in claim 9, wherein the nickel alloy comprises at least 90% nickel.

11. The turbojet rotor as recited in claim 7, wherein the metal nanoparticles comprise an alloy of iron, carbon, and at least one element selected from a group including: Mn, Ni, Cr, Mo, B, Ti, V, W, Co, Nb, P, S, and Si.

* * * * *